United States Patent [19]

Shapiro-Baruch

[11] Patent Number: 5,065,586

[45] Date of Patent: Nov. 19, 1991

[54] AIR CONDITIONER WITH DEHUMIDIFYING MODE

[75] Inventor: Ian Shapiro-Baruch, Syracuse, N.Y.

[73] Assignee: Carrier Corporation, Syracuse, N.Y.

[21] Appl. No.: 559,744

[22] Filed: Jul. 30, 1990

[51] Int. Cl.[5] ..... F25D 17/06; F25B 13/00

[52] U.S. Cl. ..... 62/93; 62/324.1; 165/3

[58] Field of Search ..... 62/324.1, 176.5, 173, 62/93, 81, 176.1, 324.5; 236/44 C; 165/3

[56] References Cited

U.S. PATENT DOCUMENTS

| | | | |
|---|---|---|---|
| Re. 30,745 | 9/1981 | Chambless | 62/324.1 |
| Re. 266,695 | 10/1969 | Jensen | 166/295 |
| 2,172,877 | 2/1939 | Parcarro | 62/173 |
| 2,222,240 | 11/1940 | Philipp | 62/93 |
| 2,515,842 | 7/1950 | Swinburne | 62/173 |
| 2,679,142 | 5/1954 | McGrath | 62/173 |
| 2,715,320 | 8/1955 | Wright | 62/342 |
| 2,770,100 | 11/1956 | Raney | 62/173 |
| 2,932,178 | 4/1960 | Armstrong et al. | 62/324.1 |
| 2,961,844 | 11/1960 | McGrath | 62/173 |
| 3,105,366 | 10/1963 | Atchison | 62/173 |
| 3,132,492 | 5/1964 | McGrath | 62/324.1 |
| 3,139,735 | 7/1964 | Malkoff et al. | 62/173 |
| 3,203,196 | 8/1965 | Malkoff | 62/173 |
| 3,264,840 | 8/1966 | Harnish | 62/173 |
| 3,293,874 | 12/1966 | Gerteis | 62/173 |
| 3,316,730 | 5/1967 | Laver | 62/173 |
| 3,402,564 | 9/1968 | Nussbaum | 62/173 |
| 3,460,353 | 8/1969 | Ogata et al. | 62/324.1 |
| 3,492,833 | 2/1970 | Marsteuer | 62/209 |
| 3,529,659 | 9/1970 | Trask | 62/324.1 |
| 3,738,117 | 6/1973 | Engel | 62/173 |
| 3,779,031 | 12/1973 | Akiyama et al. | 62/173 |
| 3,798,920 | 4/1974 | Morgan | 62/173 |
| 3,992,898 | 11/1976 | Duell et al. | 62/324 |
| 4,350,023 | 10/1982 | Kuwabara et al. | 62/176.6 |
| 4,448,597 | 5/1984 | Kuwabara et al. | 62/90 |
| 4,938,032 | 7/1990 | Mudford | 62/324.1 |

*Primary Examiner*—Albert J. Makay
*Assistant Examiner*—William C. Doerrler

[57] ABSTRACT

An air conditioning apparatus having a dehumidifying mode so that the apparatus is able both to cool and dehumidify air in a space to be conditioned and also to dehumidify air in the space with no sensible cooling of the air. The apparatus has two heat exchangers in its indoor section and two heat exchangers in its outdoor section. In its cooling mode, the apparatus operates much as a conventional vapor compression air conditioner, with both outside heat exchangers operating in series as a single evaporator. A four way reversing valve shifts to align the apparatus for its dehumidifying mode. In that mode, hot refrigerant is directed to one of the inside heat exchangers before reaching one of the outside heat exchangers that continues to function as a condenser. The cooled refrigerant bypasses the second outside heat exchanger before passing through the second inside heat exchanger that continues to function as a evaporator. Air to be conditioned flows through the indoor section so that, in the dehumidiying mode, air heated by passing over the one inside heat exchanger is mixed with air cooled and dehumidified by passing over the second inside heat exchanger at the air outlet of the air conditioner to produce a stream of dehumidified air at the approximate temperature of the inlet air. The invention is particularly suited to room air conditioner applications but may be used in other types of air conditioning systems.

5 Claims, 3 Drawing Sheets

AIR CONDITIONER WITH DEHUMIDIFYING MODE

BACKGROUND OF THE INVENTION

It is well known that maintenance of a comfortable environment requires control not only of the air temperature in the environment but also the relative humidity of the air. Air cooling systems for reducing and maintaining the air temperature at comfortable levels within an enclosed space are common. When ambient temperatures are relatively high, such systems can also dehumidify the air, for in cooling the air in the space to a comfortable temperature, the system also lowers the temperature of conditioned air to below the dew point of the air and moisture in the air condenses out.

However, conditions may exist where air in the space is at a comfortable temperature (i.e. in the range of 70° to 75° F.) (21° to 24° C.) but the relative humidity remains uncomfortably high. In these conditions, a conventional cooling system is capable of dehumidification only by further cooling the air in the space, thus lowering the temperature to a level that is not comfortable to the occupants.

Many efforts have been taken to overcome this shortcoming in conventional air cooling systems. One solution has been to provide a separate dehumidifying apparatus in the space.

Another approach has been to use an air cooling system to cool the air to lower its dewpoint and dehumidify it, then reheat it to a temperature that is within the comfort range. This reheating step has been accomplished in some designs by electric resistance heat. Still other designs of air conditioners of the vapor compression type have routed hot refrigerant from the discharge of the system compressor to a reheat heat exchanger located so that air that has first been cooled by the evaporator section of the system is warmed by a reheat heat exchanger before being directed to the space.

Most if not all of such hot refrigerant reheat designs have used two separate heat exchangers configured in a series relationship with respect to the air flow through them.

SUMMARY OF THE INVENTION

It is an object of this invention to have a means for supplying air to a space to be conditioned that is within the proper range of both temperature and relative humidity to assure the comfort of the occupants of the space.

It is another object of the invention to have a single system that is able both to cool and dehumidify, and to dehumidify without cooling the air in a space to be conditioned.

It is a further object of the invention to have an air cooling and dehumidifying system that is simple, compact and economical to manufacture.

These and other objects of the invention are achieved by providing an air conditioning apparatus that operates on the vapor compression principle but that has two heat exchangers rather than the conventional one in each of the inside and outside heat exchange sections of the apparatus and has means for reconfiguring the path of refrigerant flow through the four heat exchangers.

In its cooling mode, the apparatus operates much as a conventional vapor compression air conditioner, with the refrigerant flow path aligned so that the two inside heat exchangers are connected in series to function much as a single conventional evaporator and the two outside heat exchangers are connected in series to function much as a single conventional condenser.

In its dehumidifying mode, the refrigerant flow path in the apparatus is aligned so that hot refrigerant from the compressor discharge flow first through one of the two inside heat exchangers, that now functions as a condenser, before flowing through one of the outside heat exchangers, that still functions as a condenser, (bypassing the other outside heat exchanger), a throttling device and the other inside heat exchanger, that still functions as an evaporator. Air from the space to be conditioned passes over the two inside heat exchangers in parallel, the air that passes over the heating heat exchanger being warmed and the air that passes over the evaporating heat exchanger being cooled and dehumidified. The two streams of air are mixed as they leave the apparatus so that the air returned to the space is dehumidified but little changed in temperature from the air entering the apparatus.

The two outside and the two inside heat exchangers are constructed by dividing otherwise conventional unitary hairpin tube type heat exchangers into two sections and adding the necessary tubing, fittings and components to form the refrigerant flow paths described above. The additional expense of providing two separate heat exchanger units in the outside and inside section of the apparatus is thus avoided.

BRIEF DESCRIPTION OF THE DRAWINGS

The accompanying drawings form a part of the specification. Throughout the various drawings, like reference numbers designate like or corresponding parts or features.

DESCRIPTION OF THE PREFERRED EMBODIMENTS

Figure 1:
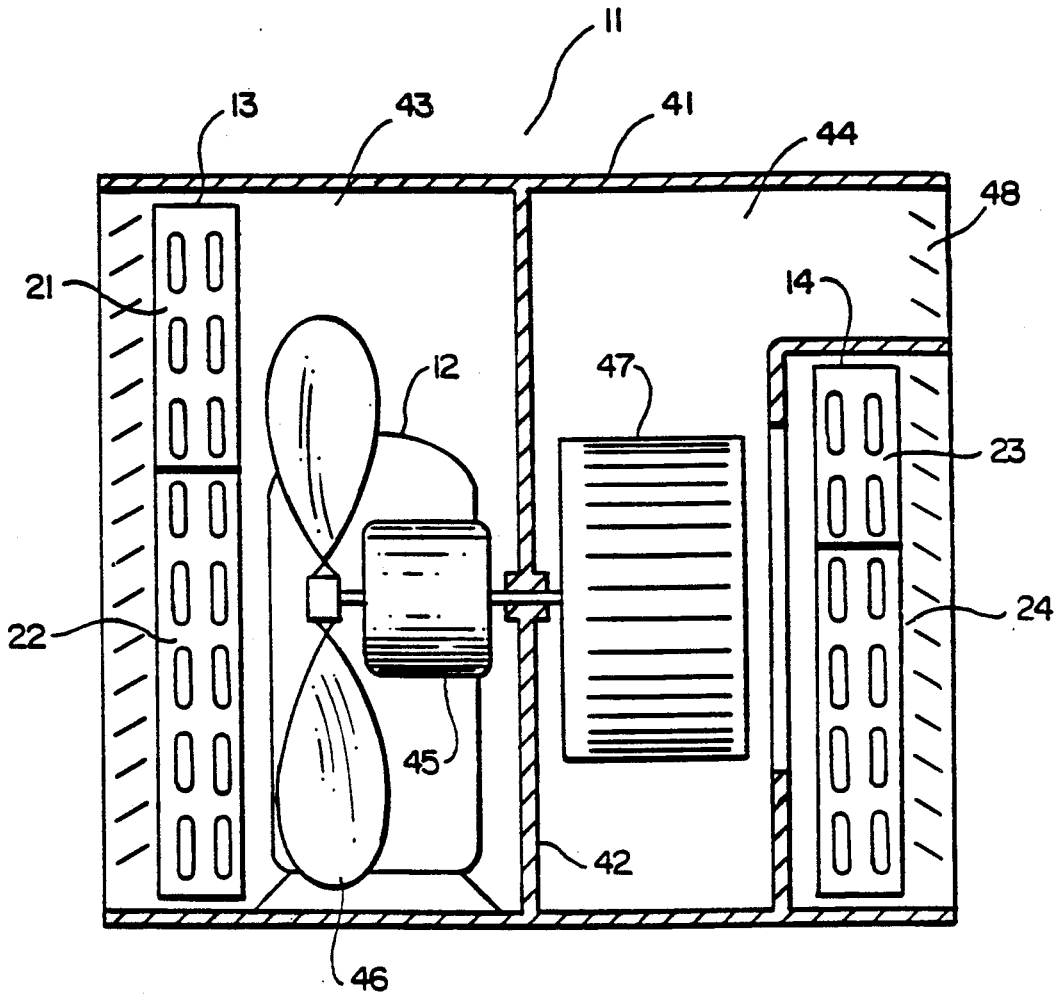
FIG. 1 depicts a schematic cross-sectional side elevation view of an air conditioner constructed according to the present invention and illustrating its major components and the air flow paths through the apparatus.

In FIG. 1 is shown a schematic cross-sectional side elevation view of an air conditioner constructed according to the present invention. Air conditioner 11 comprises enclosure 41 having partition 42 dividing enclosure 41 into outside section 43 and inside section 44. Enclosure 41 is adapted for mounting through an opening, such as a window, in the wall of a building so that outside section 43 is in communication with the outside air and inside section 44 is in communication with a space within the building to be air conditioned.

Within outside section 43 are mounted compressor 12, fan motor 45, outside fan 46 and outside heat exchanger section 13 comprising condenser 21 and condenser 22. Within inside section 44 are mounted inside fan 47 and inside heat exchanger section 14. Inside heat exchanger section 14 comprises dual function heat exchanger 23 and evaporator 24. When air conditioner 11 is in operation, outside fan 46 causes outdoor air to pass through outside section 43 and over condenser 21 and condenser 22, cooling refrigerant flowing through the two condensers. Inside fan 47 draws air from the space to be conditioned into inside section 44, over inside heat exchange section 14, cooling and dehumidifying the air before returning the air to the space. Exit louvers 48 mix air that has passed over dual function heat exchanger 23 with air that has passed over evaporator 24 as the air leaves air conditioner 11.

The parallel air flow arrangement of dual function heat exchanger 23 and evaporator 24 with mixing of the two air streams downstream of the two heat exchangers allows the use in the apparatus of a conventional hairpin coil heat exchanger that has been divided into two sections, a more economical configuration than the provision of two separate heat exchanger assemblies placed in series air flow relationship to each other. If the two heat exchangers of inside heat exchanger section 14 are mounted vertically or nearly so (as is shown in FIG. 1, evaporator 24 should be below dual function heat exchanger 23 so that when the apparatus is operating in the dehumidifying mode, condensate formed on the surfaces of evaporator 24 does not drip on to the heated surfaces of dual function heat exchanger 23 and reevaporate.

Figure 2:
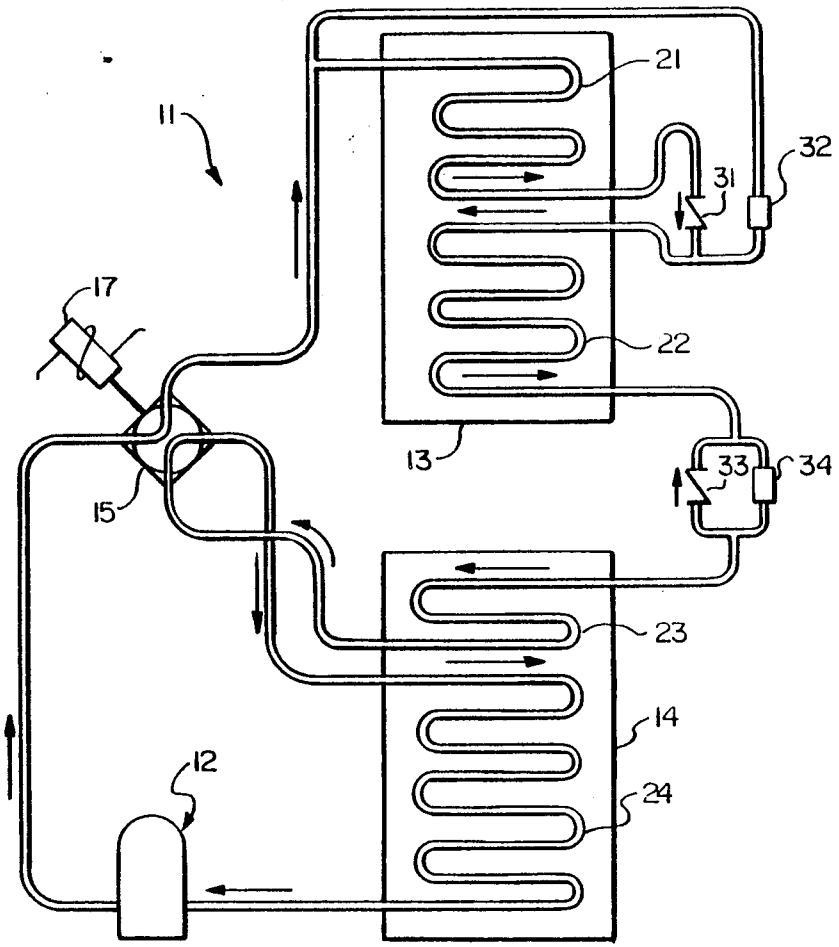
FIG. 2. depicts a schematic system diagram of an air conditioner constructed according to the present invention when operating in the cooling mode.

FIG. 2 depicts a schematic system diagram of air conditioner 11 operating in the cooling mode. In this mode, air conditioner 11 operates in much the same manner as a conventional closed cycle vapor compression air conditioning system. When operating in the cooling mode, hot refrigerant discharged from compressor 12 flows through four way reversing valve 15 to condenser 21 located in outside heat exchange section 13, then through unidirectional flow device 31 and condenser 22, also located in outside heat exchange section 13. After giving off heat and condensing in the two condensers, the refrigerant flows through throttling device 34, where its pressure is reduced, then through dual function heat exchanger 23, that in the cooling mode functions as an evaporator, located in inside heated exchange section 14, through four way reversing valve 15 and through evaporator 24, also located in inside heat exchange section 14. After absorbing heat and evaporating in dual function heat exchanger 23 and evaporator 24 in inside heat exchange section 14, the refrigerant returns to the suction of compressor 12. Because of throttling device 32, only a trickle flow of hot refrigerant can bypass condenser 21.

Figure 3:
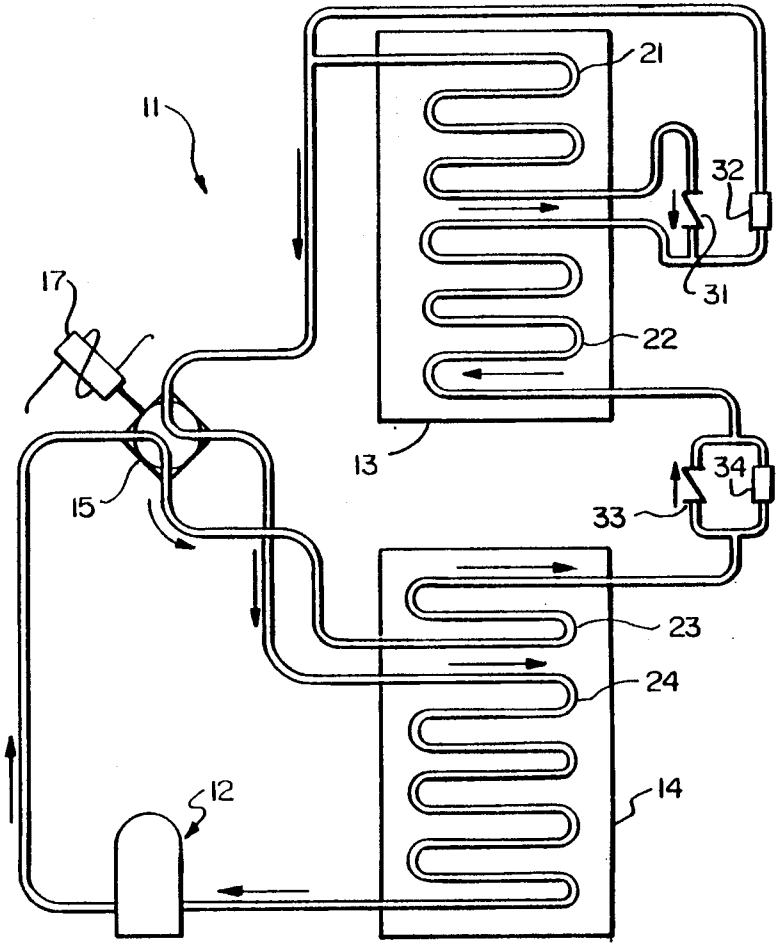
FIG. 3 depicts a schematic system diagram of a air conditioner constructed according to the present invention when operating in the dehumidifying mode.

FIG. 3 depicts a schematic system diagram of air conditioner 11 operating in the dehumidifying mode. In this mode, hot refrigerant discharged from compressor 12 flows through four way reversing valve 15 to dual function heat exchanger 23, functioning in this mode as a heater, located in inside heat exchange section 14, where it gives off heat to air flowing through inside heat exchange section 14. The refrigerant then flows through unidirectional flow device 33 and condenser 22, located in outside heat exchange section 13. After giving off heat and condensing in condenser 22, the refrigerant flows through throttling device 32, bypassing condenser 21 because of unidirectional flow device 31, and through four way reversing valve 15 to evaporator 24, located in inside heat exchange section 14. In evaporator 24, the refrigerant absorbs heat from and cools inside air passing over evaporator 24 and evaporates. The refrigerant then returns to the suction of compressor 12. Because the refrigerant flow bypasses condenser 21 in the dehumidifying mode, the condenser to evaporator heat exchange ratio is such that the saturated refrigerant suction temperature remains above freezing.

Throttling devices 32 and 34 may be orifices, thermoexpansion valves, devices such as Carrier Accuraters ® or, in a room air conditioner application, more desirably capillary tubes. A single Accurater ® may take the place of both unidirectional flow device 33 and throttling device 34.

Figure 4:
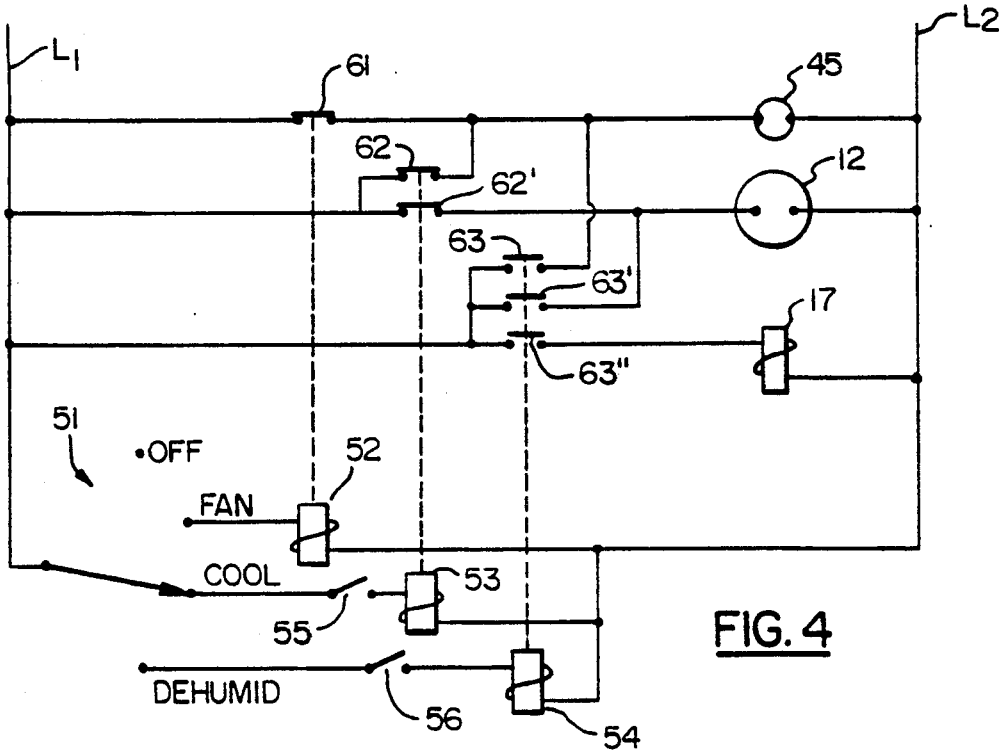
FIG. 4 depicts an electric control arrangement that may be used with an air conditioner incorporating the present invention.
Figure 5:
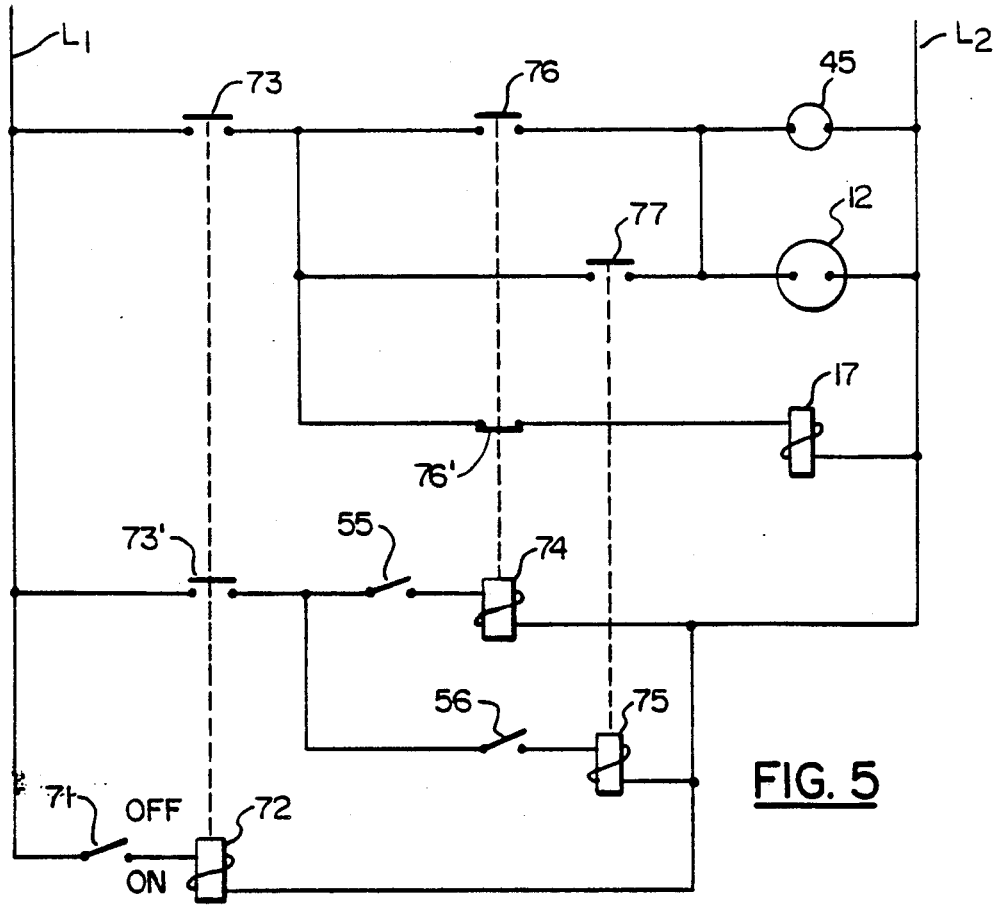
FIG. 5 depicts another electrical control arrangement that may be used with an air conditioner incorporating the present invention.

FIGS. 4 and 5 illustrate electrical control arrangements that may be used in an air conditioner incorporating the present invention. In both figures, leads $L_1$ and $L_2$ connect with a suitable electrical power source (not shown). In both figures, energizing valve operating solenoid 17 places the air conditioner in the dehumidifying mode and deenergizing solenoid 17 places the air conditioner in the cooling mode. Also in both figures, thermostat 55 comprises any suitable control device adapted to respond to air temperature in the space to be conditioned and humidistat 56 comprises any suitable control device adapted to respond to air humidity in the space to be conditioned.

FIG. 4 illustrates an arrangement suitable for an application where positive user control of the operating mode of the air conditioner is desired. In FIG. 4, fan motor 45 connects across leads $L_1$ and $L_2$ through fan mode contact 61. Compressor 12 connects across leads $L_1$ and $L_2$. Fan mode relay 52 operates fan mode contact 61. Similarly cooling mode relay 53 operates cooling mode contacts 62 and 62' and dehumidifying mode relay 54 operates dehumidifying mode contacts 63, 63' and 63''. All of contacts 61, 62, 62', 63, 63' and 63'' are made when their respective relays are energized and open when the relays are deenergized.

Mode selector switch 51 is a four position switch enabling operation of the air conditioner in one of three modes: fan only, cooling and dehumidifying. When in the FAN position, switch 51 connects fan mode relay 52 across $L_1$ and $L_2$, thus making fan mode contact 61 and energizing fan motor 45. When in the COOLING position, switch 51 connects cooling mode relay 53 across $L_1$ and $L_2$ through thermostat 55. With switch 51 in the COOLING position, when thermostat 55 closes in response to a call for cooling, cooling mode relay 53 is connected across $L_1$ and $L_2$ and is thus energized, making contacts 62 and 62' and energizing fan motor 45 and compressor 12. Fan 45 and compressor 12 will continue to operate until thermostat 55 senses the satisfaction of the demand for cooling and opens. When in the DEHUMIDIFYING position, switch 51 connect dehumidifying mode relay 54 across $L_1$ and $L_2$ through humidistat 56. With switch 51 in the DEHUMIDIFYING position, when humidistat 56 closes in response to a call for dehumidification, dehumidifying mode relay 56 is connected across $L_1$ and $L_2$ and is thus energized, making contacts 63, 63' and 63'' and energizing fan motor 45, compressor 12 and valve operating solenoid 17. Fan 45, compressor 12 will continue to operate and valve operating solenoid 17 will remain energized until humidistat 56 senses the satisfaction of the demand for dehumidification. When switch 51 is in the OFF position, none of relays 52, 53 and 54 are energized and none of the operating components of the air conditioner are energized.

FIG. 5 illustrates another electrical control arrangement suitable for an application where the only user input desired is to turn the unit on and off. In FIG. 5, fan motor 45 and compressor 12 connect across $L_1$ and $L_2$ through on-off contact 73 and thermostat contact 76. Fan motor and compressor 12 also connect across $L_1$ and $L_2$ through on-off contact 73 and humidistat contact 76. Valve operating solenoid 17 connects across $L_1$ and $L_2$ through on-off contact 73' and thermostat contact 76'. On-off contact 73 and 73', thermostat contact 76 and humidistat contact 77 are made when their respective control relays are energized. Thermostat relay 76' is open when its control relay is energized. Thermostat relay 74 connects across $L_1$ and $L_2$ through on-off contact 73' and thermostat 55. Humidistat relay 75 connects across $L_1$ and $L_2$ through on-off contact 73' and humidistat 56. On-off relay 72 connects across $L_1$ and $L_2$ through switch 71.

To place the unit in operation, the user places switch 71 in the ON position, energizing on-off relay 72 and making contacts 73 and 73'. If thermostat 55 calls for cooling but humidistat 56 does not call for dehumidification, thermostat relay 74 will energize, making contact 76 and opening contact 76' but humidistat relay 75 will remain deenergized and contact 77 will remain open. Thus fan motor 45 and compressor 12 will operate but valve operating solenoid 17 will remain deenergized and the system will operate in the cooling mode. If thermostat 55 does not call for cooling but humidistat 56 calls for dehumidification, humidistat relay 75 will energize, making contact 77 but thermostat relay 55 will remain deenergized, contact 76 will remain open and contact 76' will remain made. Thus fan motor 45 and compressor 12 will operate and valve operating solenoid 17 will energize and the system will operate in the dehumidifying mode. If thermostat 55 calls for cooling and, simultaneously, humidistat 56 calls for dehumidification, both thermostat relay 74 and humidistat relay 75 will be energized, making contact 76 and 77 and opening contact 76'. Thus fan motor 45 and compressor 12 will operate but valve operating solenoid 17 will remain deenergized and the system will operate in the cooling mode. The cooling mode therefore overrides the dehumidifying mode and simultaneous calls for cooling and dehumidification will result in the system operating in the cooling mode. If, while operating in the cooling mode with thermostat 55 calling for cooling and humidstat 56 calling for dehumidification, the air in the space being conditioned is cooled to below the set point of thermostat 55 but humidistat 56 is still calling for dehumidification, thermostat relay 74 will deenergize, opening contact 76 and making contact 76,. Fan motor 45 and compressor 12 will continue to operate because contact 77 remains made and, in addition, valve operating solenoid 17 will energize, shifting the air conditioner to the dehumidifying mode. When switch 71 is in the OFF position, relay 72 is deenergized, on-off contacts 73 and 73' are open and none of the operating components of the air conditioner are energized.

One skilled in the art will appreciate that the control arrangements described above are only two of many variations in controls that may be used in an air conditioner incorporation the present invention.

While a preferred embodiment of the present invention is described, variations may be produced that are within the scope of the invention. It is intended therefore that the invention be limited only by the scope of the below claims.

What is claimed is:

1. A vapor compressing air conditioning apparatus, having at least air cooling and air dehumidification operating modes, comprising:

a first closed refrigerant flow loop from compressor means to a first condensing heat exchanger means to second condensing heat exchanger means to first throttling means to dual function heat exchanger means to evaporating heat exchanger means to said compressor means;

a second closed refrigerant flow loop from said compressor means to said dual function heat exchanger means to said second condensing heat exchanger means to second throttling means to said evaporating heat exchanger means to said compressor means; and flow control means for causing refrigerant to flow through said first closed refrigerant flow loop when said apparatus is in its cooling operating mode and through said second refrigerant flow loop when said apparatus is in its dehumidifying mode.

2. The apparatus of claim 1 in which said flow control means comprises flow control valve means in immediate downstream refrigerant flow relationship with said compressor means, first check valve means in parallel refrigerant flow relationship with said first throttling means and second check valve means in parallel flow relationship with said second throttling means.

3. The apparatus of claim 1 in which said flow control means comprises flow control valve means in immediate downstream refrigerant flow relationship with said compressor means, first check valve means in parallel refrigerant flow relationship with said first throttling means and combined throttling and check valve means between, in refrigerant flow relationship, said second condensing heat exchanger means and said dual function heat exchanger means.

4. The apparatus of claim 1 in which said dual function heat exchanger means is in parallel air flow relationship with said evaporating heat exchanger means and said apparatus further comprises air mixing means for mixing air exiting said dual function heat exchanger means with air exiting said evaporating heat exchanger means.

5. The apparatus of claim 4 in which said air mixing means comprises louvers located in downstream air flow relationship with said dual function heat exchanger means and said evaporator heat exchanger means.

* * * * *